United States Patent [19]

Buttner et al.

[11] 4,345,128

[45] Aug. 17, 1982

[54] ELECTRICAL CONTACT POSITIONING ASSEMBLY

[76] Inventors: Horace J. Buttner, 25222 Broadwell, Harbor City, Calif. 90710; Thomas E. Buttner, 28134 Ridepoint Ct., Rancho Palos Verdes, Calif. 90274

[21] Appl. No.: 149,817

[22] Filed: May 15, 1980

[51] Int. Cl.[3] ..... H01H 3/12; H01H 3/34

[52] U.S. Cl. ..... 200/153 J; 200/159 R; 200/246; 200/16 A

[58] Field of Search ..... 200/153 J, 159 R, 159 A, 200/246, 275, 283, 160, 16 A, 16 R, 16 C

[56] References Cited

U.S. PATENT DOCUMENTS

| | | | |
|---|---|---|---|
| 661,736 | 11/1900 | Freyman | 200/159 A |
| 3,694,603 | 9/1972 | Congelliere et al. | 200/153 J |
| 4,052,581 | 10/1977 | Matsui | 200/283 |
| 4,055,736 | 10/1977 | Congelliere | 200/159 R |

FOREIGN PATENT DOCUMENTS

| | | | |
|---|---|---|---|
| 81760 | 10/1894 | Fed. Rep. of Germany | 200/159 R |

*Primary Examiner*—John W. Shepperd

*Attorney, Agent, or Firm*—Pollock, Vande Sande & Priddy

[57] ABSTRACT

An electrical switch assembly of the type including a movable contact and at least one additional contact having a free end portion lying generally across the line of travel of the movable contact and having a further portion secured against movement within the switch assembly. The switch assembly is provided with a stop member projecting into the line of travel of the free end portion for limiting following movement of the free end portion as the movable contact is retracted, ensuring a complete break in an electrical connection formed between the movable contact and the additional contact.

16 Claims, 13 Drawing Figures

10
11
12
13
14
3.
5.
15
15A
15B
16
16B
17
17A
17B
18
18B
19
22
23
24A
40
41
42
43
44
45
50
51
52
54
60
61
62
70
71
72
80
81
82
83
93
98

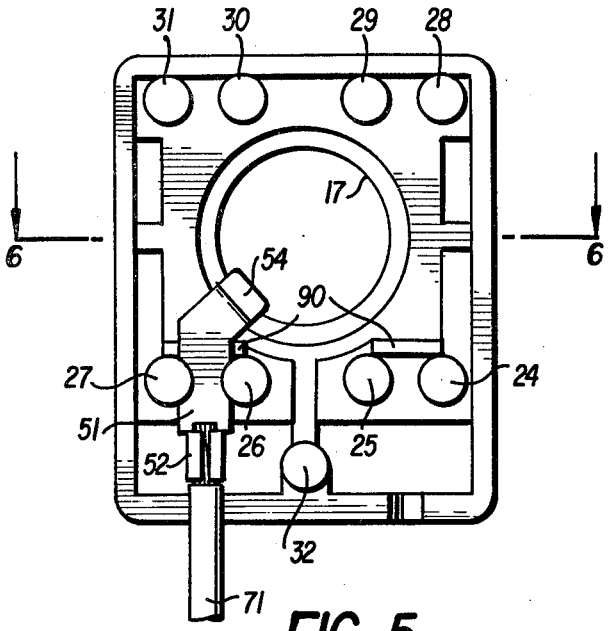
FIG. 5
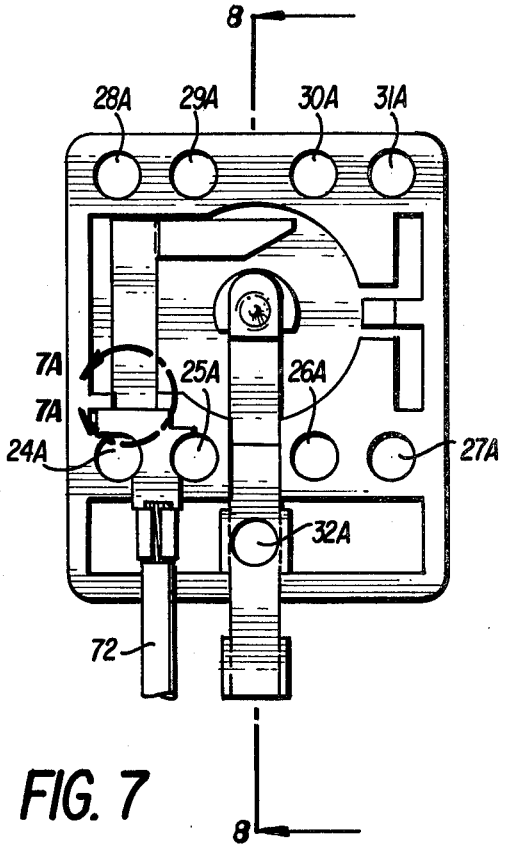
FIG. 7
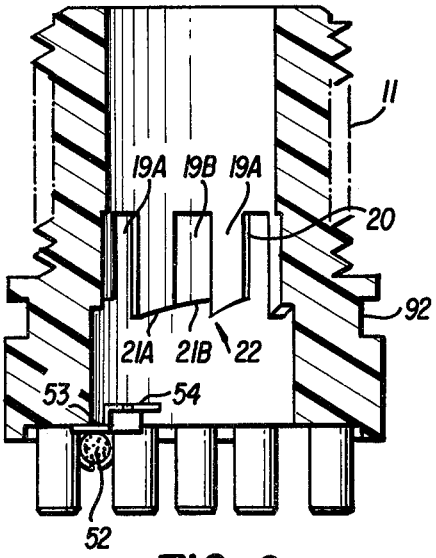
FIG. 6
FIG. 10A
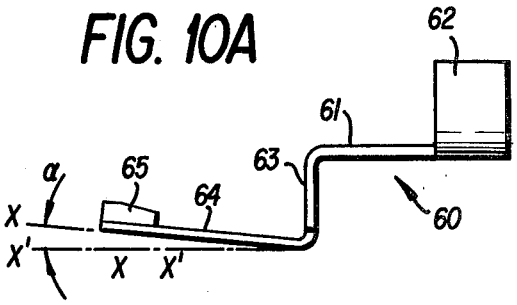
FIG. 10B
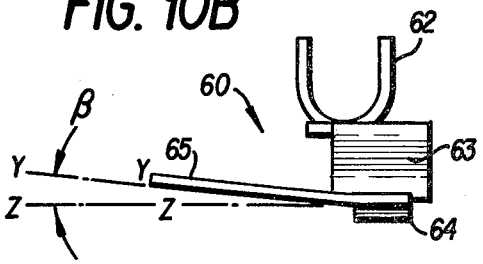

ELECTRICAL CONTACT POSITIONING ASSEMBLY

CROSS-REFERENCE TO RELATED APPLICATIONS

The present application relates to improvements in switches, including for example the short throw electrical pushbutton switch of the type generally discussed in co-pending application Ser. No. 099,943 filed Nov. 30, 1979 and assigned to one of the joint inventors of the present invention, Horace Judson Buttner. The subject matter of co-pending application Ser. No. 099,043 is hereby incorporated herein by reference.

TECHNICAL FIELD

The present invention relates to an improved electrical switch assembly which is useful in switches of compact design, including especially switches having short throw actuators.

BACKGROUND ART

The present invention is directed to an improved electrical switch assembly of the type including a movable contact arranged for selective projection and retraction through the switch assembly into and out of electrical contact with a free-standing portion of at least one separate contact terminal in order to make or break an electrical connection therebetween.

The movable contact is projected and retracted between at least two stable positions and, just before reaching at least one of these positions, makes contact with the free-standing portion. This causes deflection of the free-standing portion when the movable contact is at rest in said stable position, whereby the biasing force inherent in the deflected free-standing portion assists in making a firm electrical connection.

A plunger ratchet actuator is useful in such a switch because of its ability to create two separate stable positions spaced from one another. However, a long standing problem in such electrical switch assemblies is the tendency of the deflected free end portion to follow the movable contact during its travel toward a retracted stable position due to the natural resiliency of the free end portion. As a result, the electrical connection between the movable contact and the free end portion may not be terminated as required. Rather, the free end portion may remain in electrical contact until the movable contact actually reaches a retracted position if the switch design is compact and the gap between the two stable positions is therefore relatively small. If the switch is designed to break one electrical connection established at a projected stable position, and to establish a different electrical connection at a retracted stable position, it is evident that the resilient or springy nature of the free-standing portion can make it difficult to dependably or completely break the first-mentioned electrical connection.

In order to ensure complete separation of the electrical connection between a movable contact in a stable position and a free-standing, resilient portion of at least one further contact terminal deflected by engagement with the movable contact, many electrical switch assemblies provide a relatively large gap or throw between projected stable and retracted stable positions.

Such a large gap or throw allows the movable contact to completely separate from the free-standing portion. However, it has proven difficult, if not impossible, to employ such a long throw plunger actuator and still provide a switch assembly of extremely compact design.

As will become clear hereinafter, the present invention provides an extremely compact electrical switch assembly which employs a short throw plunger actuator and yet overcomes the many disadvantages inherent in known prior art, as discussed above, as well as additional disadvantages confronting the known prior art.

DESCRIPTION OF THE INVENTION

The present invention is an improvement on that known type of switch assembly wherein there is a first contact means movable between first and second stable positions. In at least said second stable position, the first contact is in electrically conductive contact with a second contact means. The movable contact means is moved between said first and second stable positions by a moving means, which may for example include a rotary ratcheting mechanism and has the characteristic that it causes the travel of said first contact means from said first stable position to said second stable position to include an extra motion beyond and a return to said second stable position, such as for example to allow for indexing of a ratcheting mechanism when such is used as the moving means. The second contact means includes at least one portion extending at least in part in a plane lying generally across a line of travel of the movable first contact for making electrically conductive contact with said first contact. The second contact includes biasing means for biasing at least one portion into continuous electrical engagement with the first contact when at rest in the second stable position.

According to the invention, the improved switch assembly includes stop means projecting into the line of travel of the second contact in position for limiting following movement of the second contact as the first contact is retracted from the second stable position toward the first stable position, to ensure a complete break in the electrical connection formed between the first and second contacts. In a preferred embodiment, a third contact means is arranged to engage the first contact as the first contact arrives at the first stable position preferably after the electrical connection between the first and second contacts has been terminated.

The stop means is not restricted to use in three contact switches, rather, it is within the scope of the present invention to provide the stop means in a plunger actuated electrical switch including only a movable first contact means and a second contact means having a portion lying generally across the line of travel of the movable contact. Regardless of whether two, three or more contact terminals are employed, the present invention makes it possible to have an extremely compact electrical switch assembly employing a short throw plunger mechanism, which is capable of providing complete, very dependable and precise separation of the movable contact from electrical connection with a portion of at least one additional contact biased into engagement therewith.

BRIEF DESCRIPTION OF THE DRAWINGS

A preferred embodiment of the present invention will now be described in more detail in the following portions of this specification when taken in conjunction with the attached drawings in which like reference characters identify identical apparatus, and in which:

FIG. 5 is a sectional view of the head portion of the switch assembly;

FIG. 6 is a cross-section of the switch housing taken on lines 6—6 in FIG. 5;

FIG. 7 is a sectional view of the cover portion of the switch of FIG. 1;

FIGS. 10A and 10B show longitudinal and transverse views of the dog-leg contact terminal formed in accordance with the preferred embodiment.

BEST MODE FOR CARRYING OUT THE INVENTION

Figures 1, 2:
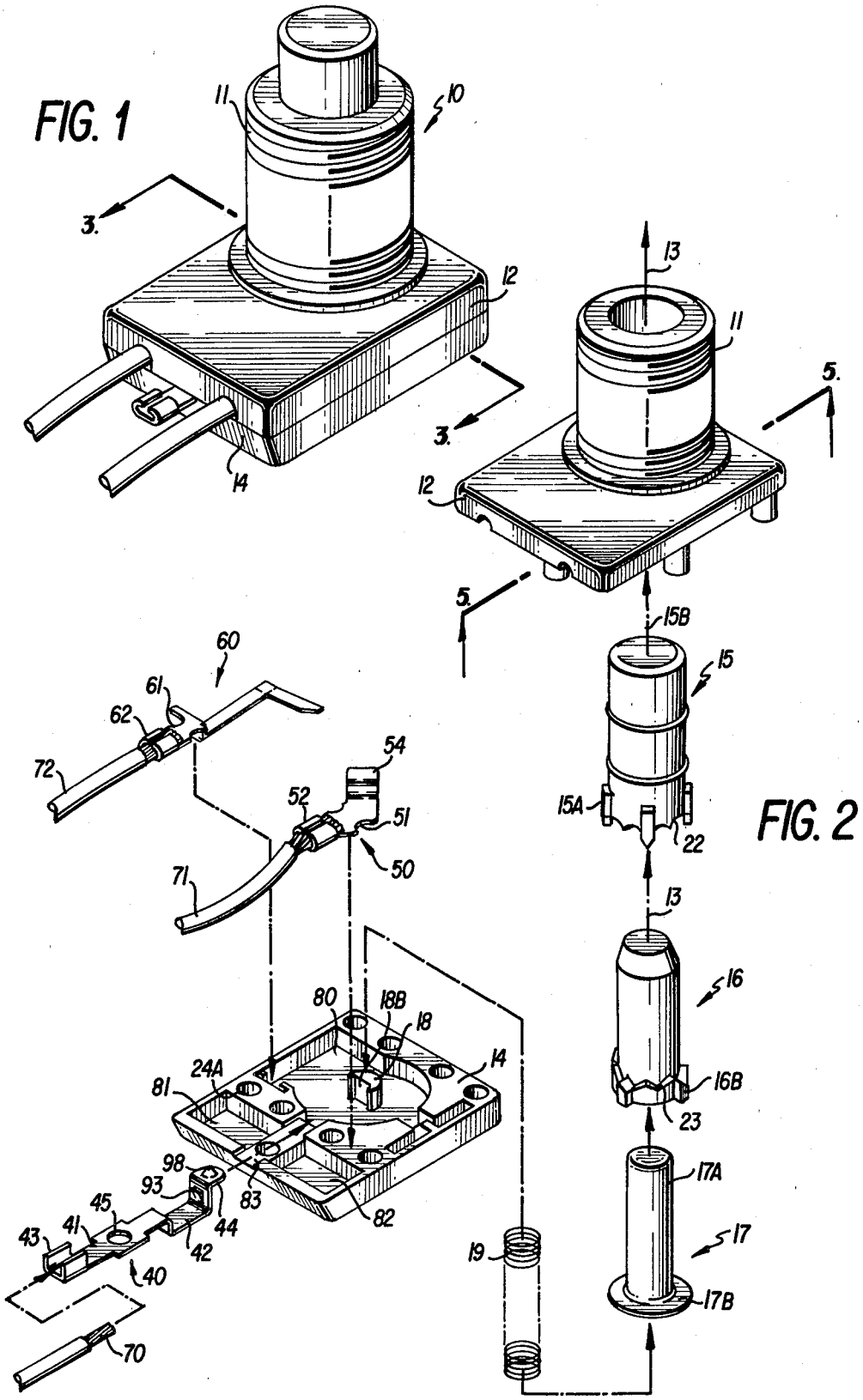
FIG. 1 is a perspective view of a pushbutton switch assembly incorporating a preferred embodiment of the present invention.
FIG. 2 is an exploded view of the switch assembly of FIG. 1.

FIGS. 1 and 2 show perspective and exploded views, respectively, of a pushbutton switch incorporating a stop member formed in accordance with a preferred embodiment of the present invention. In particular, the pushbutton switch includes a separable switch housing 10 having a first housing member including an externally threaded, barrel-shaped portion 11 having a head portion 12 attached at one end thereof. The head portion 12 extends substantially transverse to an axis 13 which, in turn, extends longitudinally through barrel portion 11. Housing 10 includes a further housing member having a cover portion 14 adaptable for positioning adjacent to head portion 12 during assembly of the switch.

The plunger and ratchet mechanism of the present invention is substantially similar to a plunger and ratchet mechanism provided in a copending application Ser. No. 099,043 assigned to the same assignee as the assignee of the present invention and is incorporated by reference thereto. A generally cylindrically-shaped plunger 15 is slidably positioned within barrel portion 11 for movement along axis 13. Plunger 15 includes an end 15B available for selective engagement with an actuator in order to selectively project plunger 15 between retracted and projected positions spaced from one another along axis 13. Fitted within plunger 15 is a generally cylindrically-shaped ratchet sleeve 16 which is also aligned for longitudinal movement along axis 13. Fitted within sleeve 16 is an electrically conductive, moveable contact 17 which is substantially thimble-shaped and includes a cylindrical portion 17A extendable within sleeve 16 and a flange portion 17B attached to one end of cylindrical portion 17A. Flange portion 17B extends in a radially outward direction from attached cylindrical portion 17A and serves to establish an electrical connection with one of two spaced contact terminals as will be described.

A guide stud 18 is attached to cover 14 and projects toward head 12 when switch 10 is in the assembled position shown in FIG. 1. Guide stud 18 has a substantially semi-circular configuration and is adaptable for projection into the cylindrical portion 17A of moveable contact 17. Guide stud 18 further includes a longitudinally extending slot 18B which serves to locate a contact terminal as will be described. During assembly, a coil spring 19 is arranged within moveable contact 17, with one end of spring 19 engaging an inner surface of cylindrical portion 17B and a further, opposite end of spring 19 supported on guide stud 18. Coil spring 19 serves to bias moveable contact 17, sleeve 16 and plunger 15 into one of two stable positions corresponding to retracted and projected positions of contact 17, respectively.

Plunger 15 carries a plurality of circumferentially spaced lugs 15A, with four such lugs 15A being employed in the preferred embodiment. Each of the lugs 15A is adaptable for sliding in one of four extended recesses or ways 19A formed between pairs of adjacently disposed ribs or splines 20, wherein each rib 20 projects radially inwardly from an interior wall portion of barrel 11. Ribs 20 extend along barrel 11 in a direction parallel to axis 13, with alternatively disposed pairs of ribs forming the extended recesses 19A. Further, alternatively disposed pairs of ribs 20 form more shallow recesses or ways 19B, with each recess 19B positioned between a pair of recesses 19A. Ribs 20 are each formed with a diagonally extending shoulder which define camming ramps 21A, as best shown in FIG. 6. Alternate ribs 20 are also formed with camming ramp extensions 21B which extend across an adjacent shallow recess or way 19B, forming a plurality of circumferentially spaced latching pockets 22. Because the lugs 15A of plunger 15 are initially arranged within recesses 19A, plunger 15 is available for projection along axis 13 of barrel 11. However, contact between the lugs 15A and adjacently disposed ribs 20 forming recesses 19A prevent angular rotation of plunger 15 relative to axis 13.

Sleeve 16 is fitted with a plurality of circumferentially spaced latch dogs 16B which are adaptable for projection into either recess 19A or 19B as will be described. Latch dogs 16B are formed with end portions each having a substantially sawtooth configuration defining camming ramps of similar configuration to the camming ramps 21A and 21B formed on ribs 20, with each latch dog camming ramp extending across an entire rear surface of the latch dog. Both plunger 15 and sleeve 16 further include circumferentially extending camming teeth mounted on exterior surfaces thereof, with camming teeth 22 mounted on plunger 15 facing similarly-shaped camming teeth 23 mounted on sleeve 16.

Referring to FIGS. 1, 5 and 6, it is noted that head portion 12 is formed with a plurality of spaced pin members, with nine pin members 24–32 being employed in the preferred embodiment. Pin members 24–32 extend substantially parallel to one another, with each pin member received within a separate recess 24A–32A correspondingly located in a confronting surface of cover 14. Pin members 24–32 are each structured to provide an interference fit with recesses 24A–32A, preventing inadvertent separation of head and cover portions 12 and 14 from their assembled positions. Furthermore, pairs of the pin members may be selectively located on opposite sides of various contact terminals located within housing assembly 10 to prevent longitudinal misalignment and even withdrawal of the contact terminals as a result of stresses applied to electrical conductors attached to the terminals.

As noted in FIG. 2, a plurality of three contact terminals 40, 50 and 60 are each arranged between head and cover portions 12 and 14, respectively. Contact terminal 40 includes a substantially flat portion 41 and a substantially U-shaped portion 42 attached to an end of flat portion 41. Attached to an opposite end of flat portion 41 is a crimped end portion 43 which can be selectively attached to a conventional electrical conductor 70. In a like manner, contact terminals 50 and 60 each are adaptable for attachment to separate electrical conductors 71 and 72, respectively. Each of the contact terminals 40, 50 and 60 constitutes a stamped terminal electrically attached to a separate conductor. Alternatively, each of the contact terminals may constitute a coined end portion of one of the electrical conductors. If coined end terminals are employed, they may be formed from a single strand of tinned conductor wire which has been coined flat. Alternatively, each of the coined ends could be formed from a plurality of separate strands of tinned conductor wire which are tightly twisted together, over-tinned and coined flat.

As shown in FIG. 2, cover 14 includes a recess 80 which completely surrounds guide post 18. Cover 14 also includes a pair of additional recesses 81 and 82 which are spaced from one another as well as from recess 80. A substantially rectangularly shaped shallow recess 83 extends between recesses 81 and 82 and engages recess 80. During assembly, the flat portion 41 of contact 40 is positioned in shallow recess 83, with the attached substantially U-shaped portion 42 extending into abutting relation with side wall portions of recess 80. A side of the substantially U-shaped portion 42 extends within slot 18B of guide stud 18, with slot 18B serving to maintain contact 40 in its properly aligned position. A further end 44 of contact 40 extends across a top surface of guide stud 18 and provides a support surface for receiving biasing spring 19. Spring 19 serves to electrically engage contact terminal 40 with moveable contact 17. It is noted that portion 41 of contact 40 is formed with a through aperture 45 which is aligned with recess 32A of cover portion 14 when contact 40 is in its proper position. As a result, pin member 32 extends through aperture 45 prior to entering recess 32A, preventing withdrawal of contact terminal 40.

Contact terminal 50 includes a flat portion 51 having a crimped end 52 which is physically attached to conductor 71 as shown in FIG. 5. Contact terminal 50 further includes a contact portion 54 which extends in a plane extending substantially parallel to a plane including portion 51.

Figure 3:
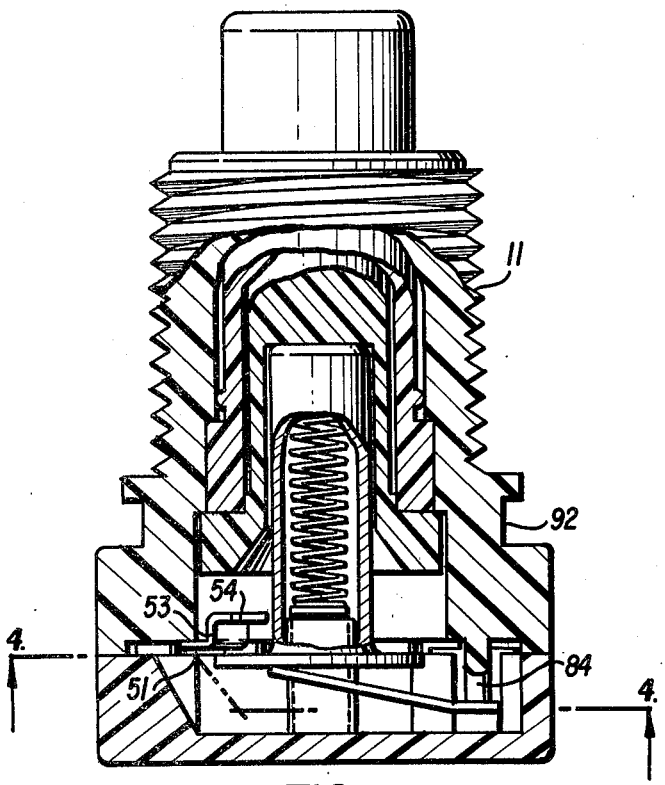
FIG. 3 is a cross-section through the switch taken along the lines 3—3 in FIG. 1.

Finally, as shown in FIG. 3, an engaging portion 53 of contact terminal 50 extends between and integrally joins portions 51 and 54 to one another. Portion 53 conforms to the shape of an inner side wall surface of barrel 11. When assembled, portion 51 is positioned adjacent to head portion 12, with engaging portion 53 extending along barrel 11. Portion 54 is angled with respect to a plane extending transversely through the longitudinal axis of portion 51, such that portion 54 extends toward the interior of cylindrical barrel 11 along a radius thereof. Portions 51, 53 and 54 of contact terminal 50 are dimensioned to allow contact between contact portion 54 and moveable contact 17 only when the plunger 15 and sleeve 17 are in their fully retracted positions, and the electrical junction between end 52 and electrical conductor 71 is selectively positioned within recess 82, as will be explained in detail hereafter.

Referring to FIGS. 2, 7, 10A and 10B, contact terminal 60 is formed to include a flat portion 61 which extends adjacent to head portion 12 as shown in FIG. 7. An end 62 of flat portion 61 is crimped to allow for engagement with electrical conductor 72. Contact terminal 60 includes a further portion 64 which extends substantially parallel to portion 61, with an engagement portion 63 extending between and engaging ends of portions 61 and 64. Portion 63 forms a substantially perpendicular angle with portion 61, as shown in FIG. 10A. However, portion 64 has been bent or angled to form less than a perpendicular angle with portion 63. In other words, the actual longitudinal axis X—X of portion 64 forms an appreciable angle $\alpha$ with an axis X'—X' extending perpendicular to portion 63. Attached to a further end of portion 64 is a further contact portion 65 which has a longitudinal axis Y—Y forming a perpendicular angle with the longitudinal axis X—X of portion 64. In addition, portion 65 is also bent such that longitudinal axis Y—Y forms an appreciable angle $\beta$ with a plane Z—Z forming an extension of the contact surface formed between portions 64 and 65. The bent portions of contact terminal 60 inherently provide a force which tends to bias contact portion 65 toward moveable contact 17. When assembled, portion 61 is positioned adjacent to head portion 14, with engaging portion 63 contacting a side wall of recess 80. The juncture between attached portions 63 and 64 conforms in shape to the juncture between attached side and bottom walls of recess 80. However, portions 64 inclines away from abutment with the bottom wall of recess 80, which bottom wall would substantially coincide with axis X'—X' of FIG. 10A. Likewise, attached portion 65 also inclines away a further distance away from the bottom wall of recess 80 as shown in FIG. 3. Because portion 64 inclines away from a bottom wall surface of recess 80, portion 64 is free to twist about its longitudinal axis to absorb or at least substantially reduce the effect of bending stresses transmitted from moveable contact 17 to contact terminal 60 when contact 17 is in its fully projected position.

During assembly, contact terminal 50 is positioned between a pair of spaced pin members 26–27, with the pins engaging a pair of grooves formed on opposite sides of portion 51 to prevent inadvertent withdrawal of contact terminal 50. In a like manner, contact terminal 60 is positioned between a pair of pin members 24–25, with the pins engaging a pair of grooves formed in opposite sides of portion 61, preventing withdrawal of contact terminal 60.

The specific deformations of various portions of contact terminal 60 provide a biasing force for maintaining electrical contact pressure between contact terminal 60 and moveable contact 17 as moveable contact 17 reaches its fully projected position, without overstressing contact terminal 60. In particular, the unique arrangement of the various portions of contact terminal 60 allows for a combination of bending of each of the portions 64 and 65 as well as a twisting of portion 64 which results in a lower overall stress level than could be obtained by bending alone.

Figure 4:
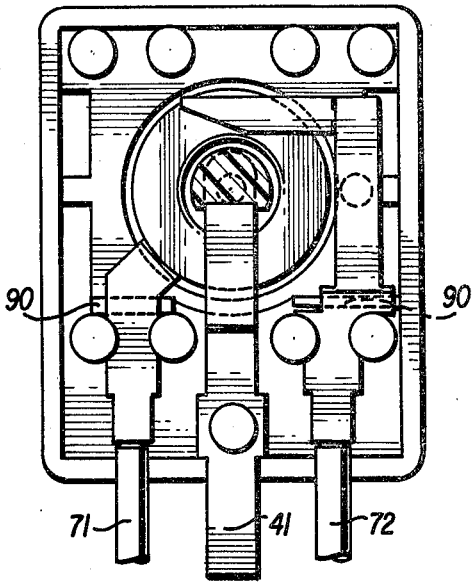
FIG. 4 is a cross-section through the head taken along the lines 4—4 in FIG. 3.

Turning now to FIGS. 3, 4 and 5, head portion 12 is shown to include a pin-shaped stop member generally designated by the numeral 84. Stop member 84 extends from head portion 12 into a portion of the recess 80 formed in cover portion 14 when head portion 12 and cover portion 14 are assembled as shown in FIG. 1. Stop member 84 is arranged to selectively engage contact terminal 60 to provide a limit on the distance contact terminal 60 may travel in the direction of contact terminal 50. In particular, the pin-shaped stop member 84 is preferably arranged to engage an intermediate portion of contact terminal portion 64 to limit the movement of attached portion 65 in the direction of terminal 50. As will be explained in detail hereafter, it is crucial to limit the movement of contact terminal 60 in order to ensure that the electrical connection between moveable contact terminal 17B and contact terminal portion 65 is broken before a further electrical connection is established between moveable contact terminal 17B and the step-shaped contact terminal 50.

Stop member 84 functions to ensure that a gap of predetermined size is maintained between contact terminals 50 and 60, allowing for construction of a compact, pushbutton actuated electrical switch having a short throw plunger. In comparison, if stop member 84 were not present, the normal biasing force inherent in the bent portions 64 and 65 would cause these portions to follow moveable contact 17B as it traveled toward contact terminal 50, raising the distinct possibility of moveable contact 17B simultaneously engaging both of the terminals 50 and 60. Without stop member 84, the gap created between contact terminals 50 and 60 would have to be relatively large, to ensure that separation between moveable contact portion 17B and terminal portion 65 occured prior to establishment of a further connection. However, a relatively wide gap would directly increase the throw of the plunger mechanism leading to an often undesirable increase in the overall size of the switch assembly itself.

In the preferred embodiment shown in FIGS. 3 and 4, the pin-shaped stop member 84 is formed as an integral part of head portion 12 and is positioned to engage the approximate center of contact portion 64. However, it is considered within the scope of the present invention to form stop member 84 as a separate structure which is then attached to head portion 12. Furthermore, stop member 84 is not limited to having a pin-shaped configuration, with the configuration of stop member 84 depending on the particular size and shape of contact terminals 60, recess 80 and even the plunger mechanism itself.

While stop member 84 is shown in FIG. 4 as a dotted line centered relative to portion 64, it is within the scope of the present invention to position stop member 84 to contact various portions of contact terminal 60 as shown by the additional phantom lines in FIG. 4 designated by the numerals 84A and 84B. Once again, the exact position of stop member 84 is dependent on the particular characteristics of the contact terminals employed in the switch assembly. The center position in FIG. 4 designated by numeral 84 is preferred in order to provide a positive stop while still allowing for the inherent biasing action of bent portion 64 to press attached portion 65 into electrical contact with moveable contact portion 17B when in the projected stable position.

Figure 11:
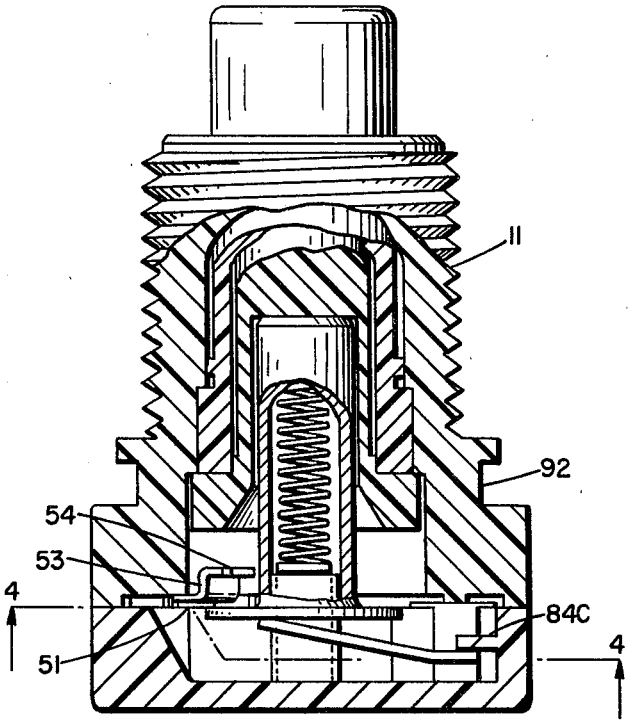
FIG. 11 is a cross-section similar to FIG. 3, showing an alternative embodiment of the present invention.

A further modification is shown in FIG. 11, wherein a stop member 84C is shown as projecting into recess 80 from an interior side wall of cover portion 14, rather than projecting from head portion 12 into recess 80. Stop member 84C will contact bent portion 64 in a manner similar to stop member 84 to positively limit the travel of contact terminal 60. Either of the stop members 84 or 84C may also be arranged to directly contact an edge of bent portion 65, rather than portion 64. However, care must be taken to ensure that the stop member does not interface with the reciprocal movement of moveable contact portion 17B or the plunger assembly itself. Therefore, if stop member 84 or 84C were to engage portion 65, it would have to be positioned to engage portion 65 at a location adjacent to the attachment with portion 64.

Figure 9:
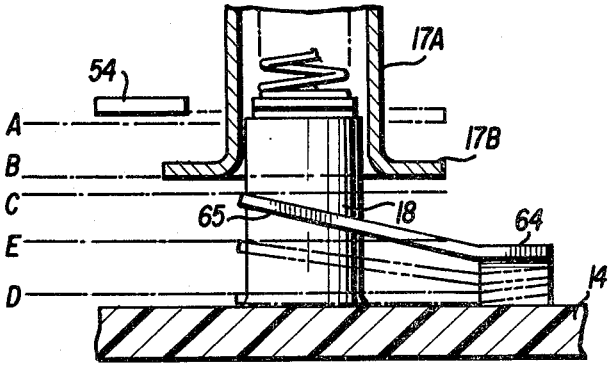
FIG. 9 is a partial blow-up of the cross-section of FIG. 3, with the plunger shown in the various positions attained following actuation of the switch.
Figure 8:
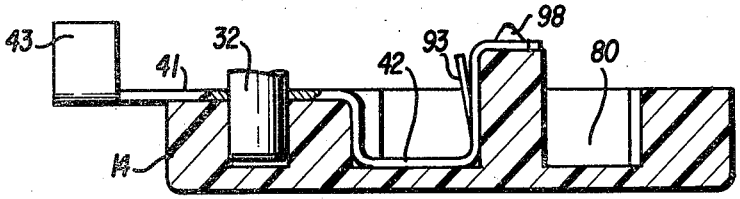
FIG. 8 is a partial cross-section of the cover member taken on the lines 8—8 in FIG. 7.

The operation of the plunger ratchet is disclosed hereafter with regard to FIGS. 2 and 9. It will be assumed that plunger 15, sleeve 16 and moveable contact 17 are in a fully retracted, stable position, wherein lugs 22 of plunger 15 and latch dogs 16B are both located in the extended recesses 19A of barrel 11. This position corresponds to the position designated by line A in FIG. 9, wherein flange portion 17B of moveable contact 17 electrically engages contact portion 54 of terminal 50. If it is further assumed that electrical conductor 70 is energized, an electrical circuit is established from conductor 70 through contact terminal 40, spring 19, moveable contact 17, contact terminal 50 and electrical conductor 71.

It will now be assumed that end portion 15B of plunger 15 is projected an intermediate distance into barrel 11 corresponding to the distance between lines A and B in FIG. 9. At the position designated by line B, plunger 15, sleeve 16 and moveable contact 17 have been moved an appreciable distance along axis 13, causing flange portion 17B to move out of electrical engagement with contact portion 54. At this point, the electrical circuit between conductors 70 and 71 has been broken. It is noted that flange 17B does not as yet engage contact portion 65 of contact terminal 60. Therefore, no electrical connection will exist between conductors 70 and 72. Due to the unique configuration of contact terminals 50 and 60 as well as the presence of stop member 84, the actual gap formed between contact terminals 54 and 65 can be kept at a minimum, requiring only a short throw plunger mechanism. This, in turn, allows for a significant reduction in the overall size of the switch assembly. As the plunger is projected a further distance through barrel 11, it reaches the position designated by line C, wherein the flange portion 17B of moveable contact 17 engages contact portion 65 of contact terminal 60. At this point, an electrical circuit is established between electrical conductors 70 and 72.

Plunger 15 is capable of further movement within barrel 11 until a position corresponding to line D is achieved. At this point, latch dogs 16B have come out of engagement with extended recesses 19A. The camming surfaces 22 and 23 of plunger 15 and sleeve 16 make camming engagement with one another. Because lugs 15A of plunger 15 remain in recesses 19A, plunger 15 is prevented from rotating. Engagement of camming surfaces 22 and 23 then forces sleeve 16 to rotatively index relative to plunger 15. This, in turn, aligns the latch dogs 16B of sleeve 16 with the ribs 20. If pressure is removed from plunger 15, spring 19 causes moveable contact 17, sleeve 16 and plunger 15 to move toward their retracted position designated by line A. However, latch dogs 16B engage camming surfaces 21A of those ribs 20 which also include the extended camming surfaces 21B. As a result, latch dogs 16B are forced into the latch pockets 22, preventing further movement of plunger mechanism 15 as well as moveable contact 17. At this point, designated by line E in FIG. 9, sleeve 17 is effectively stopped from further movement toward its retracted position, creating a projected, stable position of the plunger mechanism.

The plunger assembly as well as the contact terminals have been dimensioned to ensure that when plunger 15 achieves the projected stable position E, an electrical engagement exists between moveable contact 17 and contact terminal 60. Likewise, stop member 84 is dimensioned so as to have an engagement portion which is spaced from contact terminal 60 along axis 13 in the direction of contact terminal 50 when the projected stable position E is achieved. This means that the full biasing effect of the bent portions 64 and 65 function to maintain portion 65 in electrical contact with flange portions 17B of moveable contact 17. To return plunger 15 to its retracted stable position, plunger 15 must be once again depressed in the axial direction toward cover 14. As the plunger again reaches the projected position designated by line D, camming surfaces 22 and 23 engage one another, causing sleeve 16 to rotatively index to again align latch dogs 16B with extended recesses or ways 19A. When pressure is removed from plunger 15, spring 16 forces contact 17, sleeve 16 and plunger 15 toward the retracted stable position.

As moveable contact 17 passes the position designated by line C, the electrical connection between moveable contact 17 and contact terminal 60 is broken. In particular, when the engaged portions of terminals 17 and 60 reach the position designated by line C, portion 64 engages stop member 84, with stop member 84, preventing any further movement of portion 64 and the attached portion 65 in the direction of withdrawal of contact portion 17B. Without stop member 84, the gap formed between lines A and C would have to be much larger to ensure a break in the electrical connection between terminals 17 and 60 prior to re-establishing an electrical connection between terminals 17 and 50. Turning again to FIG. 9, moveable contact 17 continues within barrel 11 until it again reaches the retracted position shown by line A. Prior to reaching line A, no electrical circuit exists between conductor 70 and either of the conductors 71 or 72. Only when moveable contact 17 actually reaches its retracted stable position will the electrical circuit between contacts 17 and 50 be re-established. It is clear that the preferred embodiment of the present invention provides a compact switch assembly having a short throw plunger and yet is capable of breaking a first electrical circuit prior to establishing a further, different electrical circuit.

As shown in FIG. 5, a pair of rib members 90 are each attached to an interior surface of head portion 12, with rib members 90 each extending in a direction substantially transverse to the longitudinal axis of portion 61 of terminal 60 and portions 51 of contact terminal 50, respectively. Rib members 90 are each formed of a crushable material and each rib projects away from head portion 12 and extends substantially across the entire surface of portions 51 and 61 as head 12 is brought into engagement with cover 14. Because ribs 90 are each formed of crushable material, they are deformed when pressed against portions 51 and 61, respectively. As a result, the crushable ribs 90 bias or press contact terminals 50 and 60 into engagement with surface portions of cover 14. This means that each of the contact terminals can be accurately positioned within housing 10 even though the contact terminals vary slightly in size due to manufacturing tolerances. Furthermore, the extended length of the crushable rib contacting portion 61 of contact 60 prevents portion 61 from twisting out of its properly aligned position as a result of stresses received from moveable contact 17.

Figure 7A:
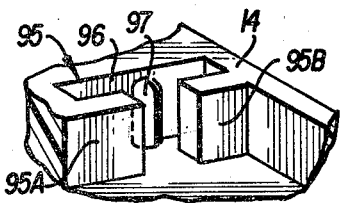
FIG. 7A is a perspective view in detail of the contact terminal receiving pocket taken on the lines 7A—7A in FIG. 7.

Referring now to FIG. 7A, a pocket 95 is formed on cover 14 in order to lock portion 63 of contact terminal 60 against any undesirable movement within housing 10. If portion 63 were to undergo movement, such movement would be effectively amplified with respect to the free contact portion 65 of terminal 60, causing sufficient misalignment of portion 65 to possibly render the entire switch assembly inoperable for multi-circuit actuation. Pocket 95 includes a pair of side wall lip portions 95A and 95B which extend toward one another and define a gap of sufficient width so as to allow portion 64 of terminal 60 to pass therethrough. A back wall 96 of pocket 95 is formed with a nob 97 which extends outwardly therefrom. Nob 97 is substantially cylindrically-shaped and functions to bias or press portion 63 against lip portions 95A and 95B, thereby ensuring proper positioning of contact terminal 60 within recess 80. During assembly, pocket 95, crushable rib 90 and stop pin 84 each functions to maintain a portion of contact terminal 60 in its proper position within housing assembly 10. Even though specific contact terminals 60 may vary slightly in size from one another, the unique structure of the switch housing discussed hereabove ensures that the contact portion 65 of contact terminal 60 is properly positioned relative to moveable contact 17.

While the preferred embodiment is directed to an on-on type electrical switch employing a stop member as defined by the present invention, the present invention is not limited to use in an on-on type switch. Rather, the present invention is believed to have a broad range of application in almost any type of electrical switch assembly wherein compact design dictates the need for a short throw plunger actuator or the like to selective project a moveable contact terminal into electrical engagement with at least one contact terminal supported within the switch assembly and having an intersecting portion lying generally across the line of travel of a portion of the moveable contact. In such an assembly, a stop member may extend from one part of the switch housing into a position adjacent a surface of the intersecting portion to prevent the intersecting portion from following the moveable portion during a preselected withdrawal of the moveable contact from engagement with the intersecting portion. Such a stop member may project along an axis extending parallel to the line of travel of the contact terminal as with stop member 84 in FIG. 3, or the stop member may project transversely to the line of travel as in FIG. 11. In a like manner, the switch assembly is not limited to employing a single stop member, rather, a plurality of separate stop members or a single stop member with a plurality of separate engagement surfaces may be included to limit the movement of a corresponding plurality of separate contact terminals in a multi-circuit switch assembly.

In view of the foregoing, the scope of the invention is to be defined by the claims appended hereto and not merely the various embodiments discussed herein.

We claim:

1. An electrical switch assembly comprising: a first contact means movable between first and second stable positions spaced from one another within said switch assembly;

moving means for moving said first contact means between said first and second stable positions, said moving means having the characteristic that its travel during the moving of said first contact means from said first stable position to said second stable position causes an extra motion of said first contact means beyond, followed by a return to, said second stable position;

a second contact means positioned to contact said first contact means in said second stable position and having a configuration including a deflectable portion initially extending at least in part in a plane lying generally across the line of travel of said first contact means between said first and second stable positions, whereby said movable fist contact means contacts and deflects said deflectable portion while moving toward said second stable position;

a third contact means positioned for contacting said movable first contact means when said first contact means is in said first stable position; and, stop means attached to said switch assembly and including a portion intersecting the line of travel of said deflectable portion for limiting the deflection of said deflectable portion in the direction toward said first stable position to ensure complete separation of said first and second contact means prior to said first contact means reaching said first stable position.

2. An electrical switch assembly according to claim 1, wherein said switch assembly includes first and second housing portions adjacently disposed to one another.

3. An electrical switch assembly according to claim 2, wherein said first contact means comprises a contact terminal portion located within said adjacently disposed housing portions and having an end portion electrically engaged to an electrical conductor, said first contact means further including a movable contact portion arranged for movement between said first and second stable positions, with said movable contact portion electrically engaged to a further end of said contact terminal portion.

4. An electrical switch assembly according to claim 2, wherein said stop means comprises a member integrally attached to one of the first and second housing portions and projecting within a space formed within at least one of said housing portions, said member having an end portion confronting said deflectable portion of said second contact means and positioned to engage and prevent said deflectable portion from remaining in contact with said movable first contact means when the latter arrives at said first stable position.

5. An electrical switch assembly according to claim 1, wherein said third contact means comprises a contact terminal arranged between said housing portions and having an end electrically engaged to an electrical conductor, said contact terminal includes a further end extending in a plane lying generally across the line of travel of said first contact means, which plane substantially coincides with said first stable position of said first contact means, whereby said first contact means and said contact terminal form an electrical connection with one another when said first contact means reaches said first position.

6. An electrical switch assembly according to claim 1, wherein said second contact means comprises a plurality of attached portions, which portions extend in at least one plane lying generally across the line of travel of said first contact means, said portions having longitudinal axes which are at a sufficient angle in their respective plane or planes whereby one of said portions, when deflected by said movable first contact means, can cause torsional strain in at least one of the remaining attached portions.

7. An electrical switch assembly according to claim 1, wherein said stop means comprises a member extending within a space in said switch assembly along an axis substantially parallel to the line of travel of said movable first contact means and including an end portion confronting said deflectable portion of said second contact means, said end portion being positioned to engage and prevent said deflectable portion from remaining in contact with said movable first contact means when the latter arrives at said first stable position.

8. An electrical switch assembly according to claim 1, wherein said stop means comprises a member extending within a space in said switch assembly along an axis substantially transverse to the line of travel of said movable first contact means and including a surface portion confronting said deflectable portion of said second contact means, said surface being positioned to engage and prevent said deflectable portion from remaining in contact with said movable first contact means when the latter arrives at said first stable position.

9. A pushbutton electrical switch assembly comprising: a first contact means movable between first and second stable positions spaced from one another within said switch assembly;

moving means for moving said first contact means between said first and second stable positions, said moving means including a rotary ratcheting mechanism having the characteristic that its travel during the movement of said first contact means from said first stable position to said second stable position causes an extra motion of said first contact means beyond, followed by a return to, said second stable position to allow for indexing of said ratcheting mechanism;

a second contact means positioned to contact said first contact means in said second stable position and having a configuration including a deflectable portion initially extending at least in part in a plane lying generally across the line of travel of said first contact means between said first and second stable positions, whereby said movable first contact means contacts and deflects said deflectable portion while moving toward said second stable position;

a third contact means positioned for contacting said movable first contact means when said first contact means is in said first stable position; and, stop means attached to said switch assembly and including a portion intersecting the line of travel of said deflectable portion for limiting the deflection of said deflectable portion in the direction toward said first stable position to ensure complete separation of said first and second contact means prior to said first contact means reaching said first stable position.

10. A pushbutton electrical switch assembly according to claim 9, wherein said switch assembly includes first and second housing portions adjacently disposed to one another.

11. A pushbutton switch assembly according to claim 10, wherein said first contact means comprises a contact terminal portion located within said adjacently disposed housing portions and having an end portion electrically engaged to an electrical conductor, said first contact means further including a movable contact portion arranged for movement between said first and second stable positions, with said movable contact portion electrically engaged to a further end of said contact terminal portion.

12. A pushbutton electrical switch assembly according to claim 10, wherein said stop means comprises a member integrally attached to one of the first and second housing portions and projecting within a space formed within at least one of said housing portions, said member having an end portion confronting said deflectable portion of said second contact means and positioned to engage and prevent said deflectable portion from remaining in contact with said movable first contact means when the latter arrives at said first stable position.

13. A pushbutton switch assembly according to claim 9, wherein said third contact means comprises a contact terminal arranged between said housing portions and having an end electrically engaged to an electrical conductor, said contact terminal includes a further end extending in a plane lying generally across the line of travel of said first contact means, which plane substantially coincides with said first stable position of said first contact means, whereby said first contact means and said contact terminal form an electrical connection with one another when said first contact means reaches said first position.

14. A pushbutton electrical switch assembly according to claim 9, wherein said second contact means comprises a plurality of attached portions, which portions extend in at least one plane lying generally across the line of travel of said first contact means, said portions having longitudinal axes which are at a sufficient angle in their respective plane or planes whereby one of said portions, when deflected by said movable first contact means, can cause torsional strain in at least one of the remaining attached portions.

15. A pushbutton electrical switch assembly according to claim 9, wherein said stop means comprises a member extending within a space in said switch assembly along an axis substantially parallel to the line of travel of said movable first contact means and including an end portion confronting said deflectable portion of said second contact means, said end portion being positioned to engage and prevent said deflectable portion from remaining in contact with said movable first contact means when the latter arrives at said first stable position.

16. A pushbutton electrical switch assembly according to claim 9, wherein said stop means comprises a member extending within a space in said switch assembly along an axis substantially transverse to the line of travel of said movable first contact means and including a surface portion confronting said deflectable portion of said second contact means, said surface being positioned to engage and prevent said deflectable portion from remaining in contact with said movable first contact means when the latter arrives at said first stable position.

* * * * *